US011992780B2

(12) United States Patent
Frison

(10) Patent No.: US 11,992,780 B2
(45) Date of Patent: May 28, 2024

(54) ROLLER COASTER VEHICLE

(71) Applicant: Michele Frison, Montagnana (IT)

(72) Inventor: Michele Frison, Montagnana (IT)

(73) Assignee: TEAM IX, INC., Newbury Park, CA (US)

( * ) Notice: Subject to any disclaimer, the term of this patent is extended or adjusted under 35 U.S.C. 154(b) by 927 days.

(21) Appl. No.: 16/963,727

(22) PCT Filed: Nov. 8, 2019

(86) PCT No.: PCT/US2019/060480
§ 371 (c)(1),
(2) Date: Jul. 21, 2020

(87) PCT Pub. No.: WO2021/086411
PCT Pub. Date: May 6, 2021

(65) Prior Publication Data

US 2021/0402310 A1 Dec. 30, 2021

Related U.S. Application Data

(60) Provisional application No. 62/927,977, filed on Oct. 30, 2019.

(51) Int. Cl.

| | |
|---|---|
| ***A63G 7/00*** | (2006.01) |
| ***A63G 21/04*** | (2006.01) |
| ***A63G 21/08*** | (2006.01) |
| ***A63G 31/02*** | (2006.01) |

(52) U.S. Cl.
CPC ..... *A63G 7/00* (2013.01); *A63G 21/04* (2013.01); *A63G 21/08* (2013.01); *A63G 31/02* (2013.01)

(58) Field of Classification Search
CPC ..... A63G 7/00; A63G 21/08; A63G 21/20; A63G 1/28; A63G 21/04; A63G 31/02; B61B 1/02; B61B 13/04
See application file for complete search history.

(56) References Cited

U.S. PATENT DOCUMENTS

| | | | | |
|---|---|---|---|---|
| 815,211 A * | 3/1906 | Pattee | ..... | A63G 7/00 105/330 |
| 3,610,160 A * | 10/1971 | Alimanestianu | ..... | B61B 1/02 104/165 |
| 6,523,479 B1 * | 2/2003 | Schilke | ..... | A63G 21/08 104/57 |

(Continued)

FOREIGN PATENT DOCUMENTS

| | | | | |
|---|---|---|---|---|
| DE | 19546694 A1 * | 6/1997 | ..... | B61B 13/04 |

*Primary Examiner* — Zachary L Kuhfuss
*Assistant Examiner* — Cheng Lin
(74) *Attorney, Agent, or Firm* — Fulwider Patton LLP

(57) ABSTRACT

A roller coaster vehicle is disclosed with seats that are mounted to a circular frame, and where the seats and the frame swing about a central horizontal axis passing between the seats, while the vehicle moves along a standard roller coaster track. The swinging or rotating of the seats with respect to the reference frame of the vehicle leads to a more intense riding experience. In a first preferred embodiment, the seats rotate passively in response to various gravitational and centripetal forces caused by the movement of the car along the track, but the seats could also be actively rotated by motors or other mechanical elements.

1 Claim, 12 Drawing Sheets

(56) References Cited

U.S. PATENT DOCUMENTS

| | | | | |
|---|---|---|---|---|
| 8,066,576 | B2 * | 11/2011 | Threlkel | A63G 7/00 104/53 |
| 10,799,804 | B2 * | 10/2020 | Walser | A63G 7/00 |
| 10,881,973 | B2 * | 1/2021 | Swasey | A63G 21/08 |

* cited by examiner

ROLLER COASTER VEHICLE

CROSS-REFERENCES TO RELATED APPLICATIONS

This application is based upon and claims the benefit of priority from the prior Patent Application No. PCT/US2019/060480, filed on Nov. 8, 2019, which claims priority from U.S. Ser. No. 62/927,977, filed Oct. 30, 2019, the entire contents of which are incorporated herein by reference.

BACKGROUND

Roller coasters cars are designed to safely secure a passenger while the roller coaster train moves along a track through various turns, hills, and even loops. These cars tend to be low profile, easy to ingress and egress vehicles with shoulder harnesses or roll bars to keep the passenger securely in the vehicle. The seats of these traditional vehicles tend to be forward facing and stationary with respect to the vehicle axles so that, from the frame of reference of the vehicle itself, the passenger is relatively stationary.

SUMMARY OF THE INVENTION

The present invention is a new type of roller coaster vehicle that moves along a roller coaster track using a runner/guide system that is similar to existing roller coaster vehicles. However, the seats of the vehicle are mounted to a circular frame that swings about a central horizontal axis passing between the seats, while the vehicle moves along the track, so that the seats move relative to the car and relative to the track. In a first preferred embodiment, the seats rotate passively in response to various gravitational and centripetal forces caused by the movement of the car along the track, but the seats could also be actively rotated by motors or other mechanical elements. These and other features of the present invention will best be understood in connection with the accompanying drawings and the detailed description of the invention below.

DETAILED DESCRIPTION OF THE PREFERRED EMBODIMENTS

Figure 1:
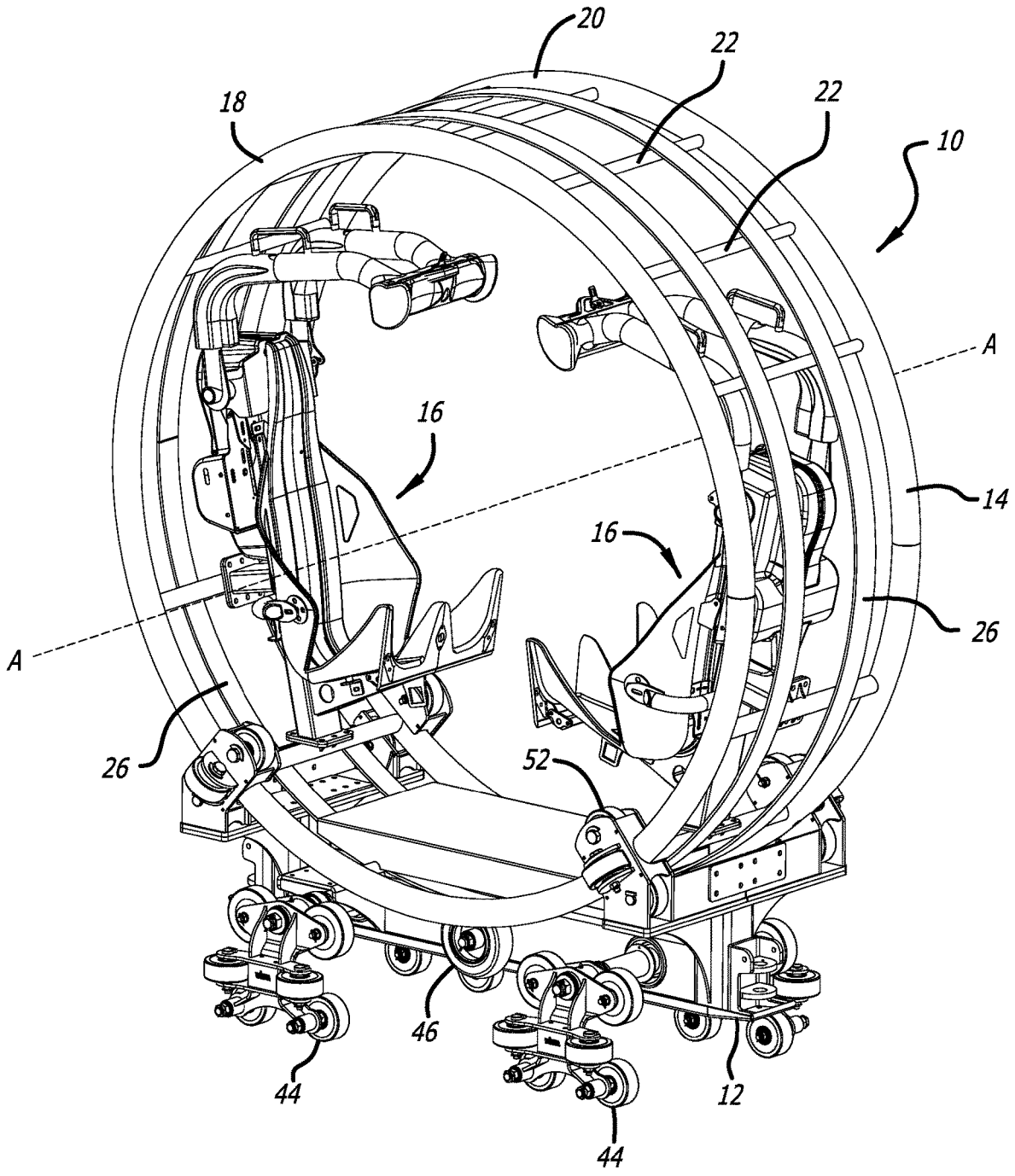
FIG. 1 is an elevated, perspective view of a first embodiment of the vehicle of the present invention.

FIG. 1 illustrates a first preferred embodiment of the present invention depicting a roller coaster vehicle 10 comprising a carriage assembly 12 and a seat frame assembly 14. The seat frame assembly 14 mounts a pair of opposed seats 16 that ride along a circular brace within the seat frame assembly 14 so that the seats swing about a horizontal axis of rotation "A." The carriage assembly 12 includes runners that ride along the top, side, and bottom of the roller coaster railing to secure the vehicle 10 to the railing. The present invention allows riders of the vehicle 10 to swing inside as the vehicle rides along the roller coaster track to enhance the experience of the riders. The seat frame assembly 14 is cylindrical and comprises a first and tubular member defining a first outer ring 18 and a second tubular member defining a second outer ring 20, the first and second rings 18,20 connected by a plurality of cross bars 22 to form an annular chassis 24. A pair of hoop bands 26 circumvent the annular chassis 24 at the cross bars 22 to solidify the seat frame assembly 14 and provide a track whereby support wheels 46 bear against the chassis 24 to support it and allow it to rotate as detailed below.

Figure 2:
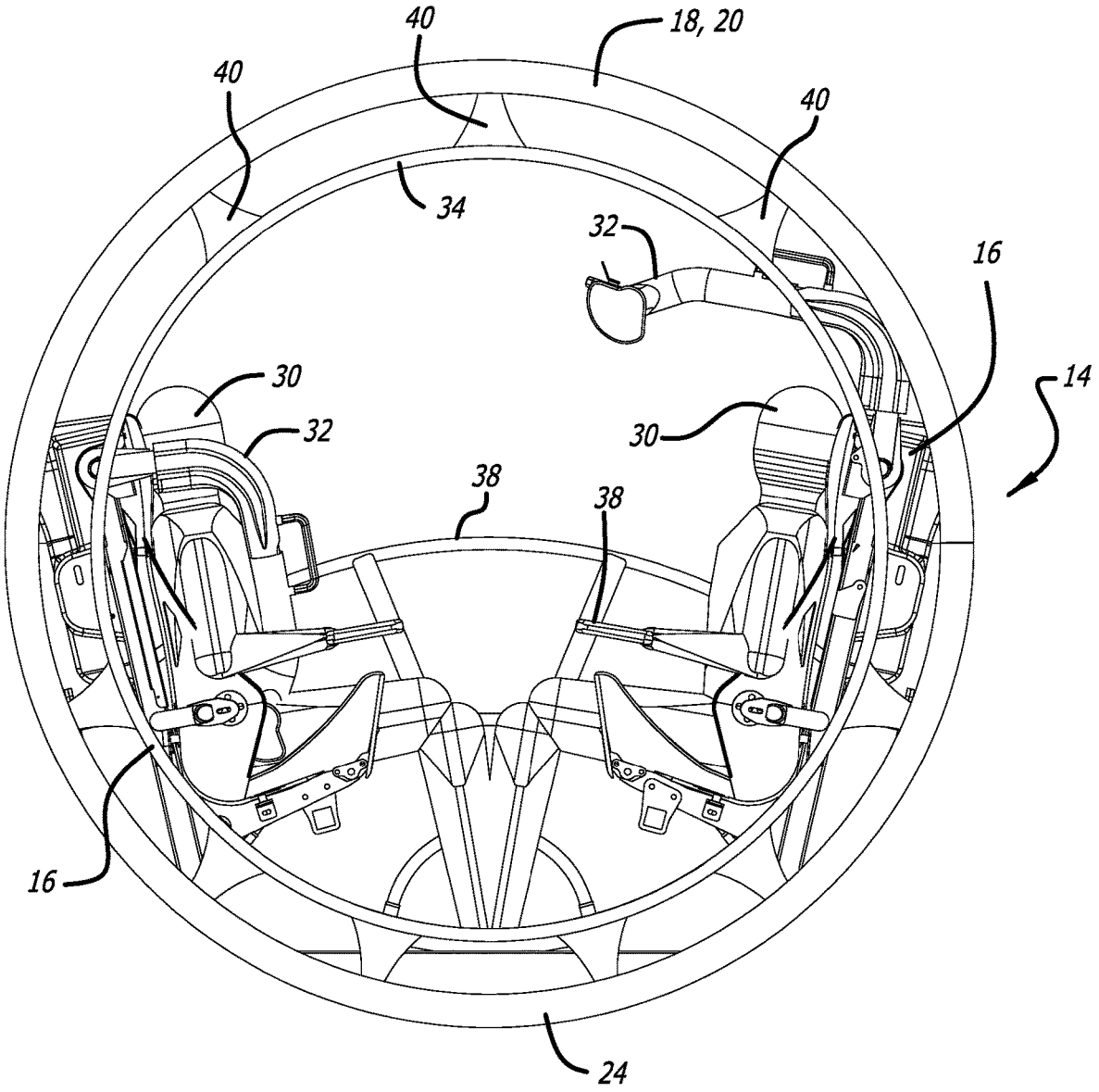
FIG. 2 is a side view of the seats and frame of the vehicle of FIG. 1 with the seats horizontally aligned.

FIG. 2 is a side view that illustrates the seat frame assembly 14 with a pair of riders 30 seated in their respective seats 16. Retractable shoulder harnesses 32 are shown in the engaged and disengaged positions, where disengaged is used for ingress and egress and engaged is used during operation of the vehicle. The riders 30 are shown in a neutral or balanced position with the seats essentially horizontally equal. The chassis 24 mounts an inner circular brace 34 that strengthens and supports the chassis 24. The inner circular brace 34 is attached to the chassis 24 by circumferentially spaced radial brace mounts 40. Extension bars 38 connect ends of the inner circular brace 34 and serve as a barrier and adds strength to the structure. The inner circular brace 34 and the extension bars 38 are inboard of the outer rings 18, 20 and along with the seats 16 and chassis form the seat frame assembly 14.

Figure 3:
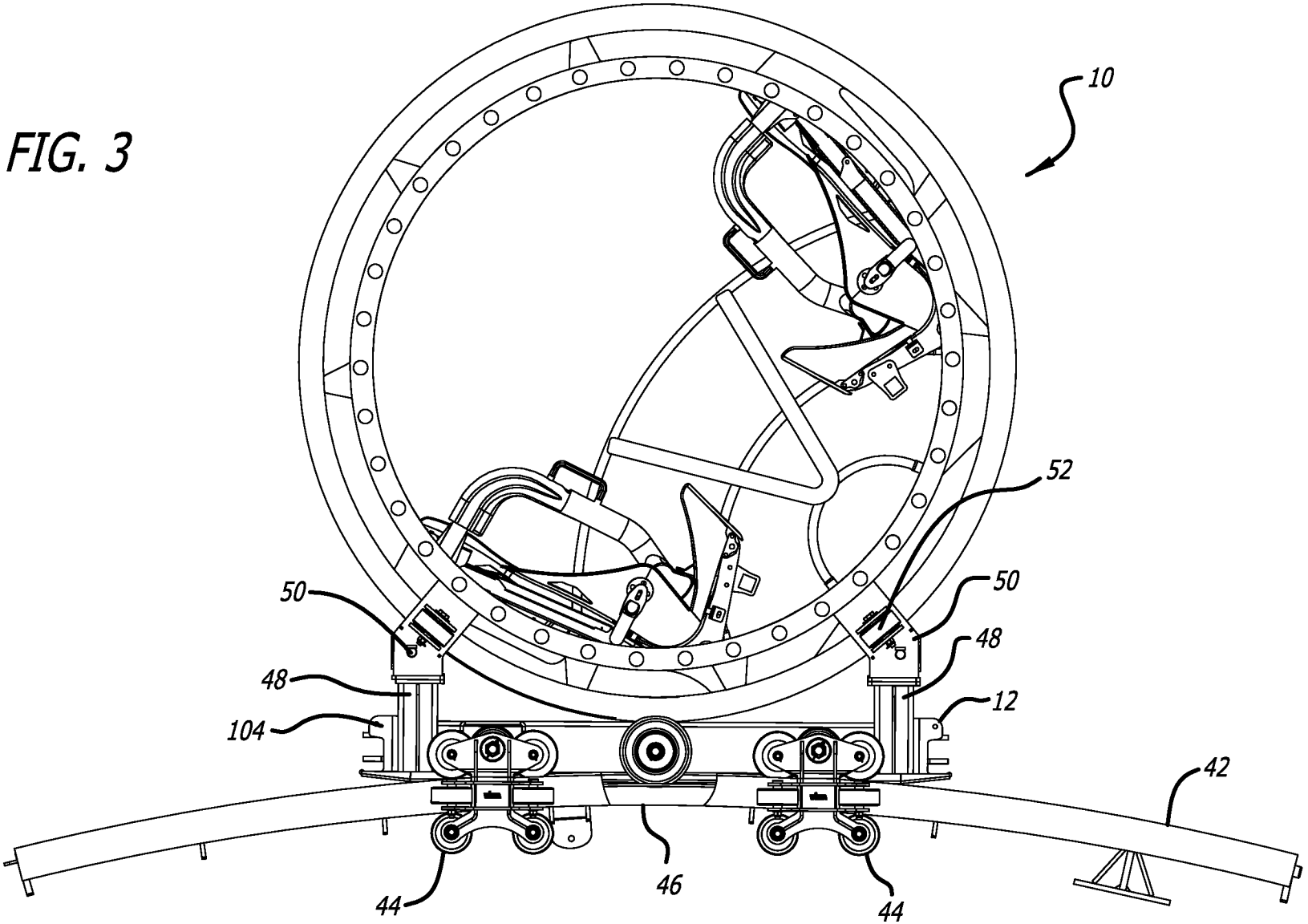
FIG. 3 is a side view of the embodiment of FIG. 1 moving along a track with the seats rotated counterclockwise to a non-horizontally aligned position.

FIG. 3 shows the vehicle 10 moving along a roller coaster track 42 in the direction of travel shown by arrow "B." The carriage assembly 12 supports the seat assembly 14 and secures the vehicle 10 to the track 42 using upper, lateral, and lower runners 44 to clamp and guide the vehicle on the track 42, as is known in the art. The seat frame assembly 14 is supported on the carriage assembly 12 by first and second load bearing vertical rollers 46 that engage the hoop bands 26 of the chassis 24 so that the chassis rolls on the rollers 46 as the vehicle moves along the track 42. The load bearing vertical rollers 46 are mounted on an axle that passes through the carriage assembly 12 that allows the rollers 46 to rotate while supporting the seat frame assembly thereon.

The carriage assembly 12 further comprises a main body supporting platforms 48 that position support arms 50 for receiving respective outer rings 18, 20. Rollers 52 are mounted in the support arms 50 at the aperture so that the chassis 24 can swing on the carriage assembly 12 through the support arms 50. The carriage assembly has front and back support platforms, each of which mounts left and right support arms 50, to provide a four position support for the attachment of the chassis 24 to the carriage assembly 12, and these four supports combine with the two rollers 46 to supports the majority of the weight of the chassis, allowing the chassis to rotate freely within the carriage assembly. As shown in FIG. 3, this allows the seats 16 to rotate within the seat frame assembly 14 so that a line joining the top of the seats can approach the vertical while the vehicle is moving in a horizontal direction.

Figure 4:
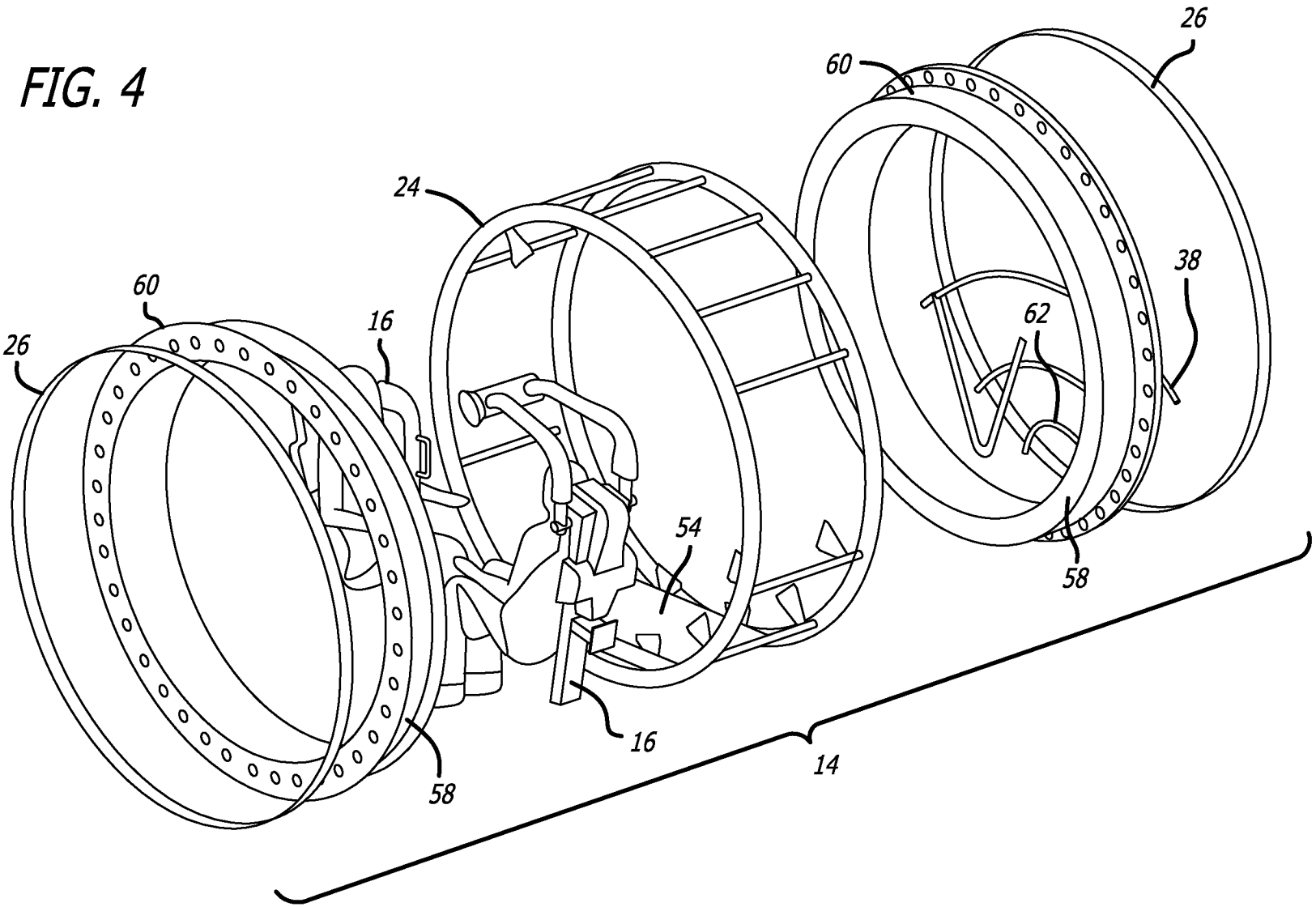
FIG. 4 is an exploded view of the vehicle upper frame assembly.

FIG. 4 is an exploded view of the seat frame assembly 14. The chassis 24 supports a seat plate 54 onto which is mounted the first and second seats 16. The inner circular brace 34 is formed by left and right rims 58 each having an outer flange 60 with a plurality of circumferentially spaced apart fastener holes used to secure the inner circular brace 34 to the radial brace mounts 40. Extension bar 38 connects outer ring 20 and with secondary connectors 62 can serve as a gate or enclosure for the vehicle 10. Hoop bands 26 enclose the chassis 24 and serve as strengtheners for the chassis and the seat frame assembly 14.

Figure 5:
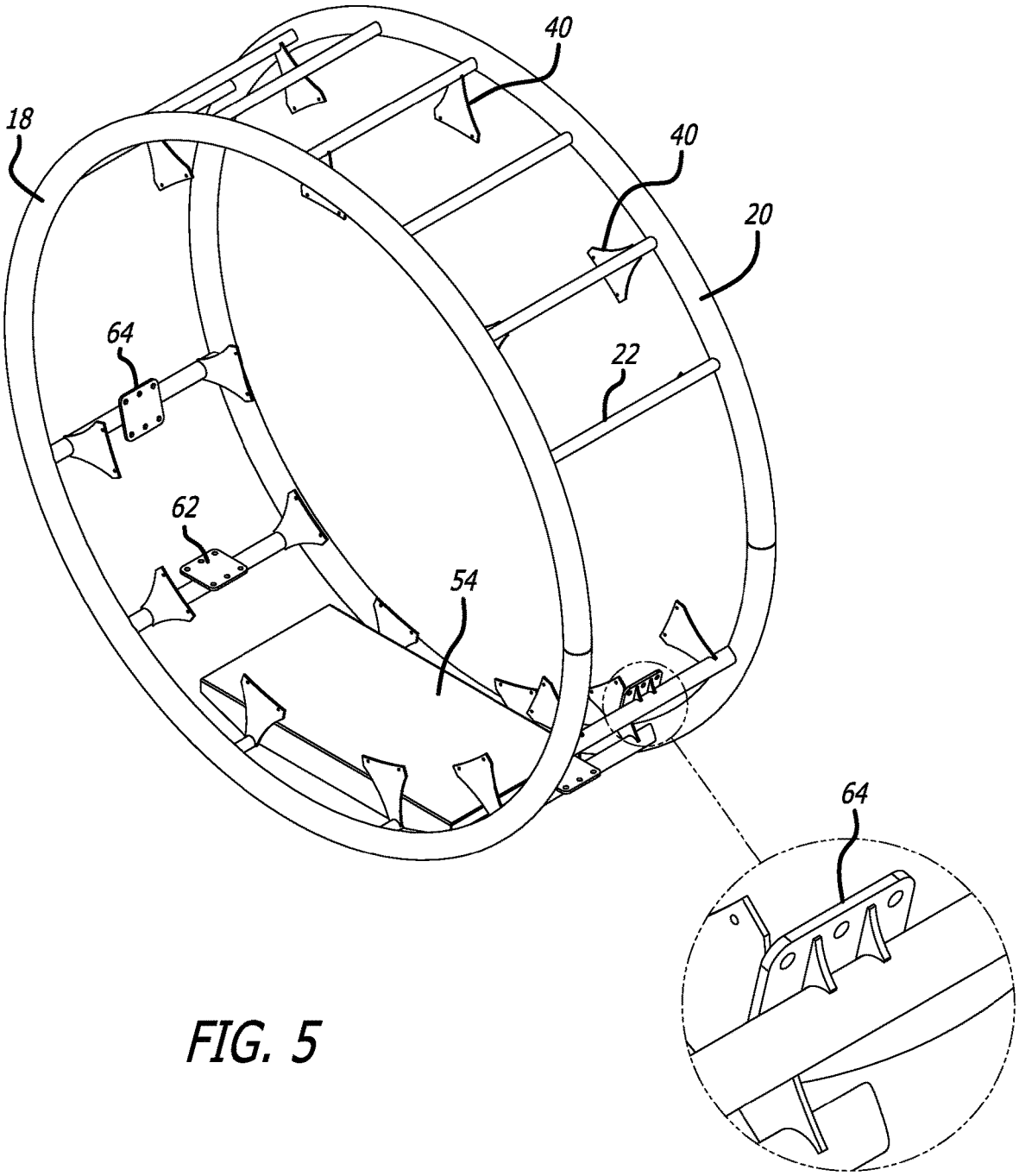
FIG. 5 is an elevated, perspective view of the upper frame.
Figure 6:
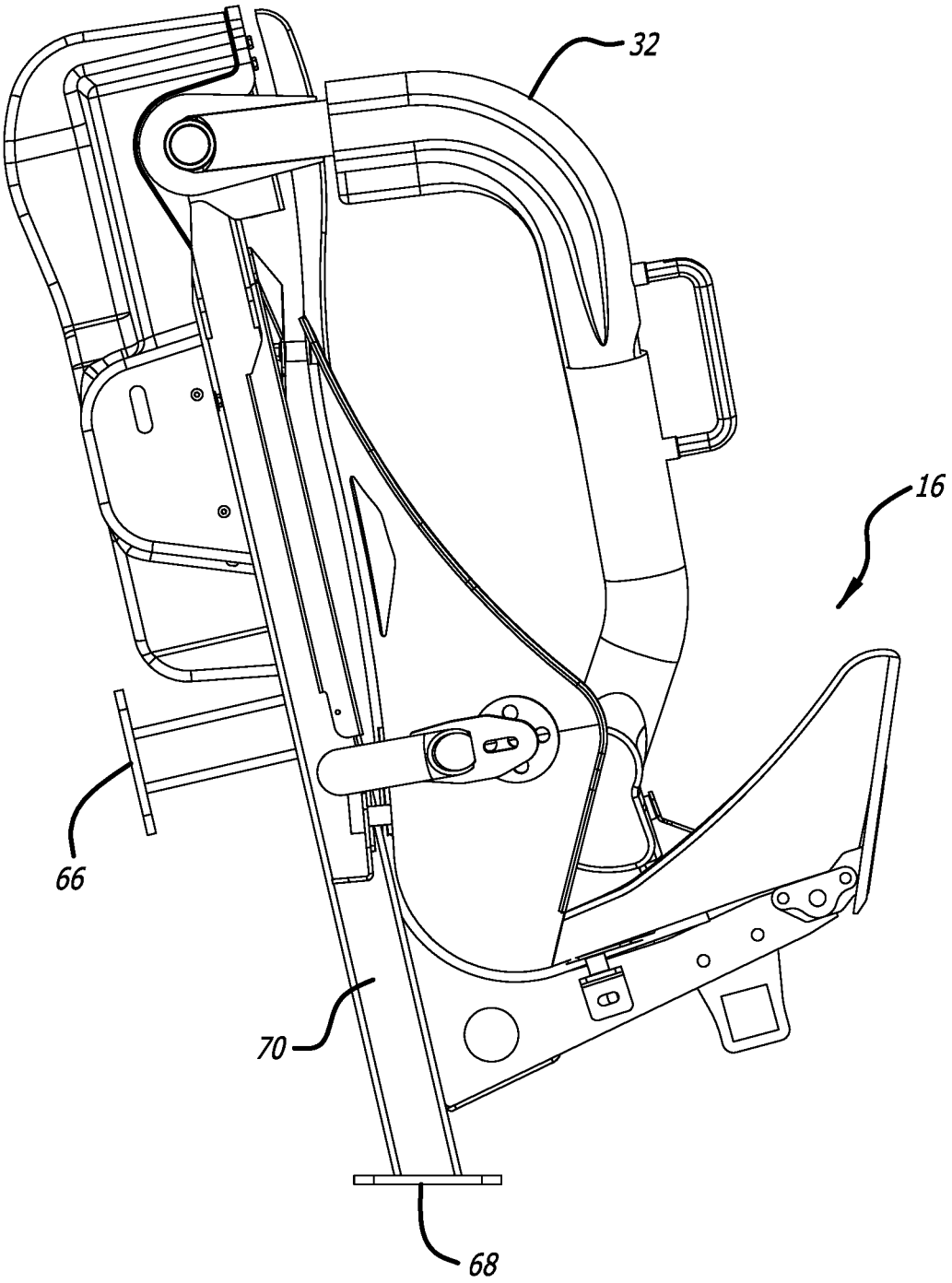
FIG. 6 is a side view of the seat mount and seat assembly.
Figure 7:
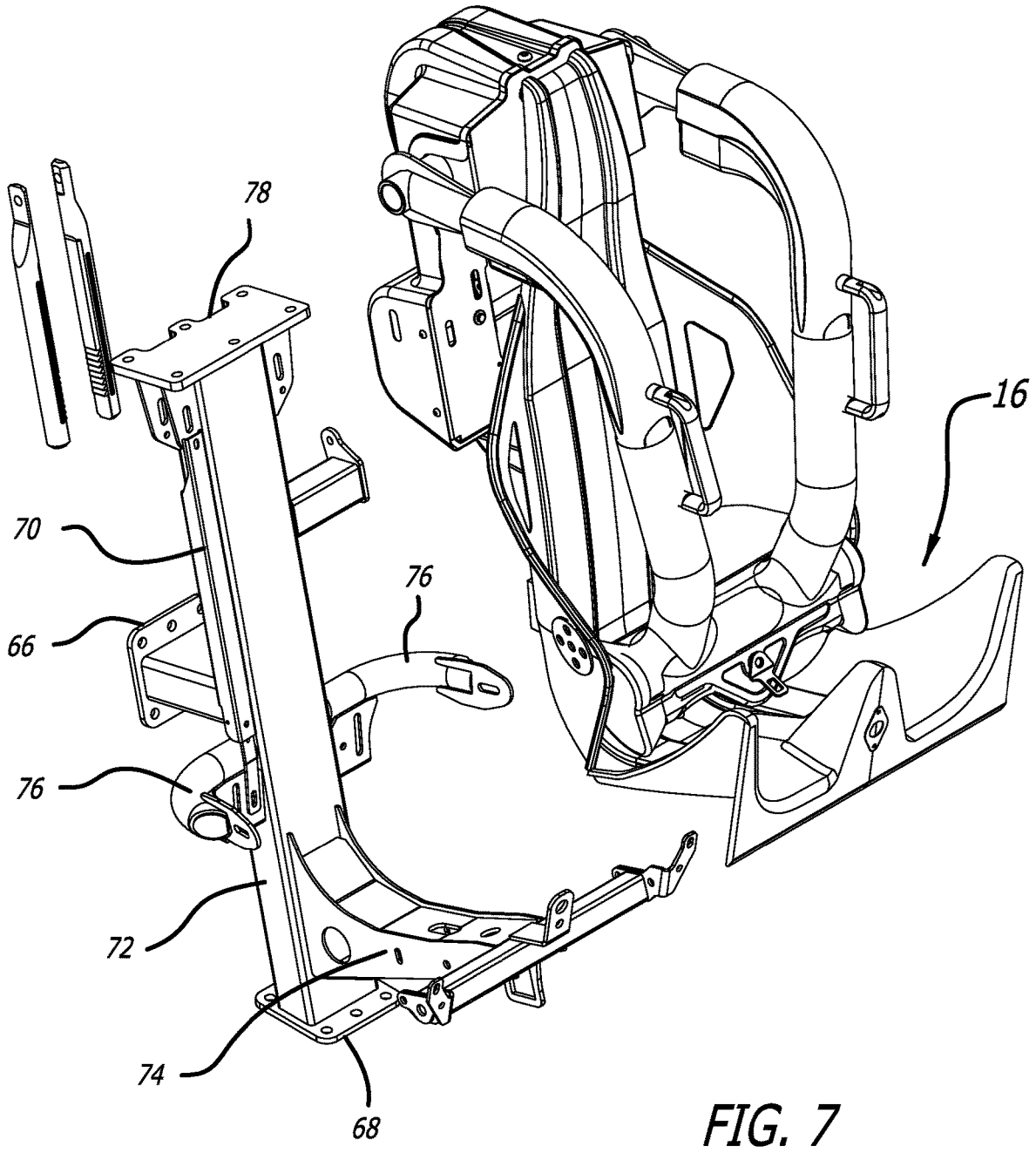
FIG. 7 is an exploded view of the seat mount and seat assembly.
Figure 9:
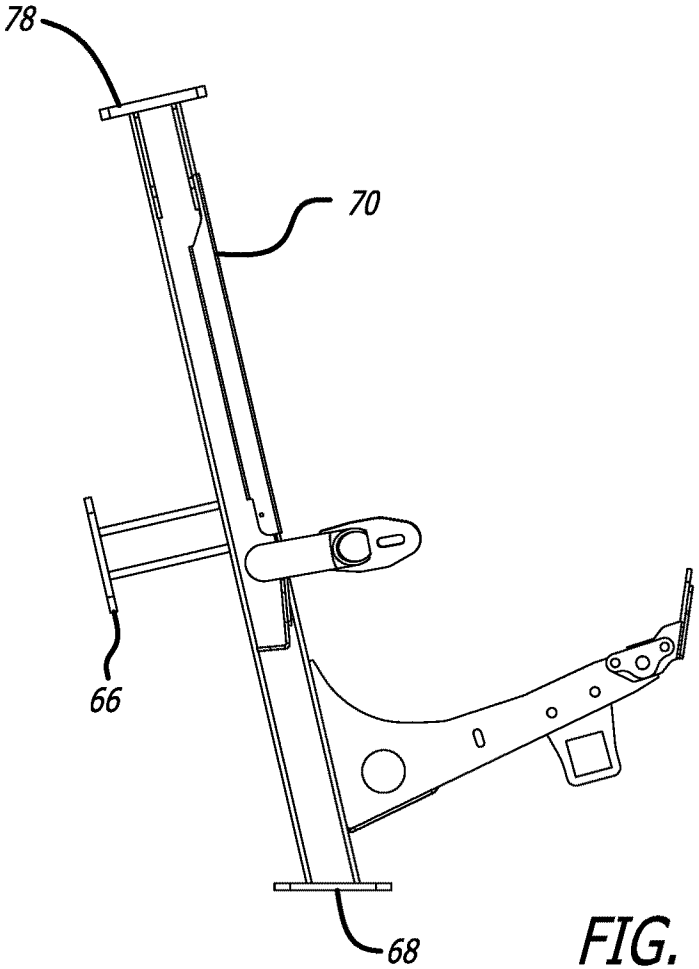
FIG. 9 is a side view of the seat mount.
Figure 8:
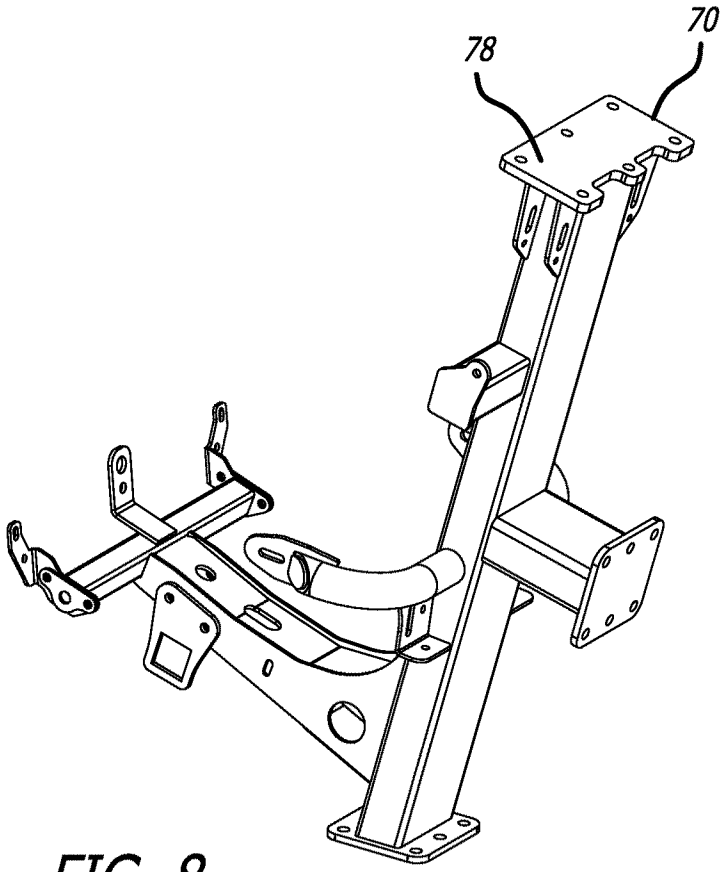
FIG. 8 is an elevated, perspective view of the seat mount.

FIG. 5 illustrates the first outer ring 18 and second outer ring 20 with cross bars 22 forming the chassis 24 that supports the seat plate 54. The radial brace mounts 40 project inwardly from their respective cross bars 22 to mount the inner circular brace 34. The first cross bar above either side of the seat plate 54 is formed with a horizontal seat mounting plate 62, and the cross bar above that includes a vertical seat mounting plate 64, which mount respectively to seat vertical plate 66 and seat horizontal plate 68 of seat mounting bracket 70 (FIGS. 6, 7). FIGS. 6 and 7 illustrate the seat mount bracket 70 and seat 16 coupled and in exploded view. The seat mount bracket 70 comprises a base 72 and an attachment beam 74 that support the chair 16, and a pair of arms 76 that attach to the sides of the chair 16 for additional support. The attachment beam 74 includes tabs that receive fasteners to secure the chair, and the base 72 includes a upper plate 78 that receives a mating surface on the chair for further attachment. FIGS. 8 and 9 illustrate the seat mount bracket 70 in perspective and side views.

Figure 10:
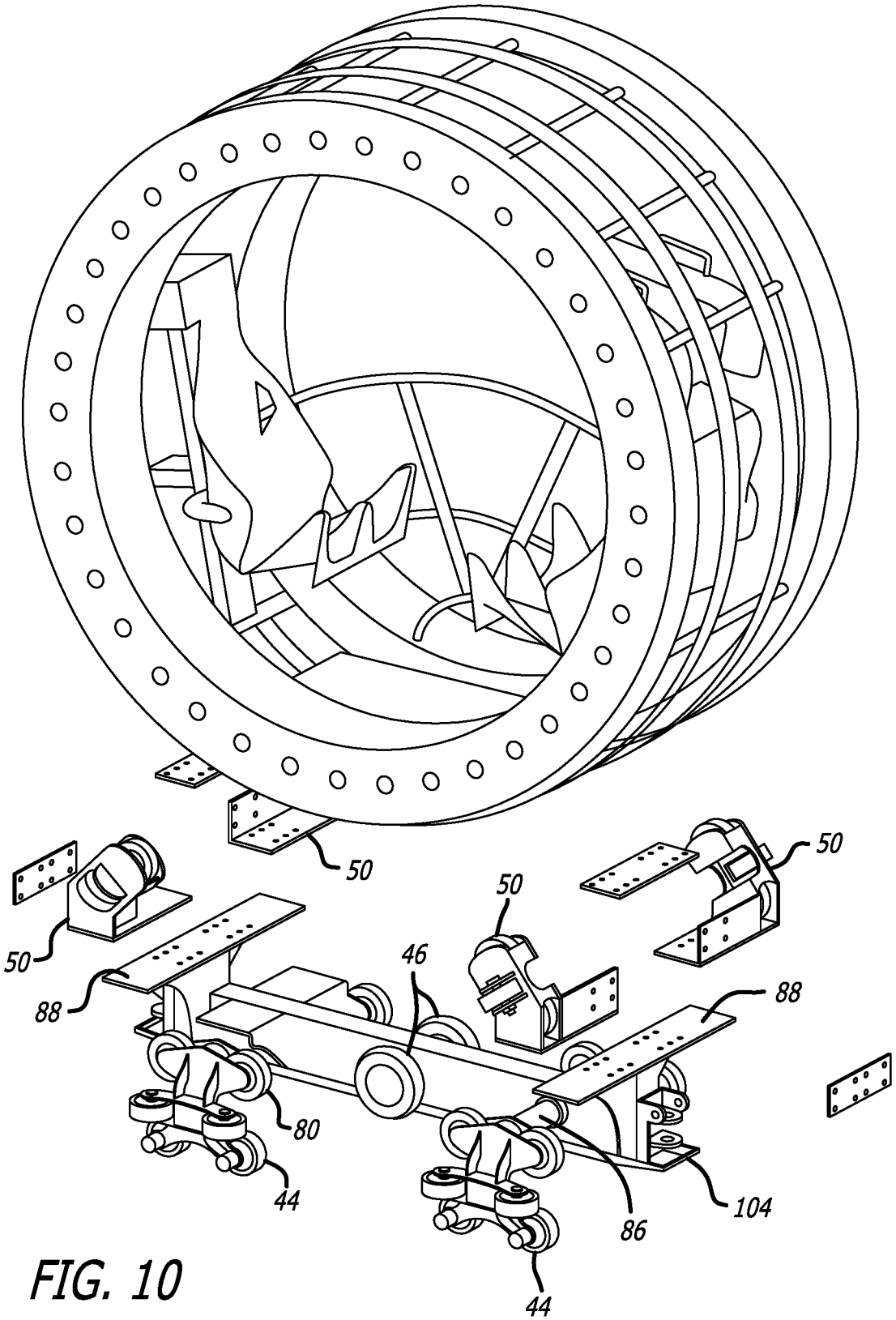
FIG. 10 is an exploded view of the vehicle carriage assembly.
Figure 11:
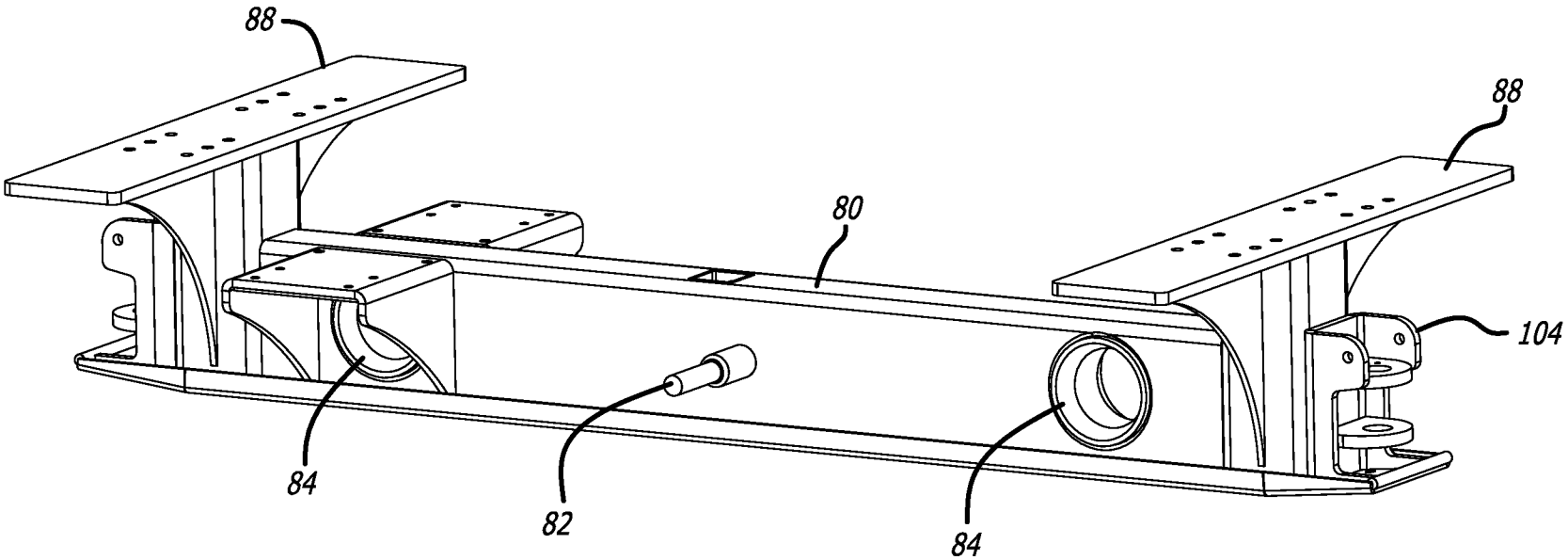
FIG. 11 is an elevated, enlarged perspective view of the carriage frame.
Figure 12:
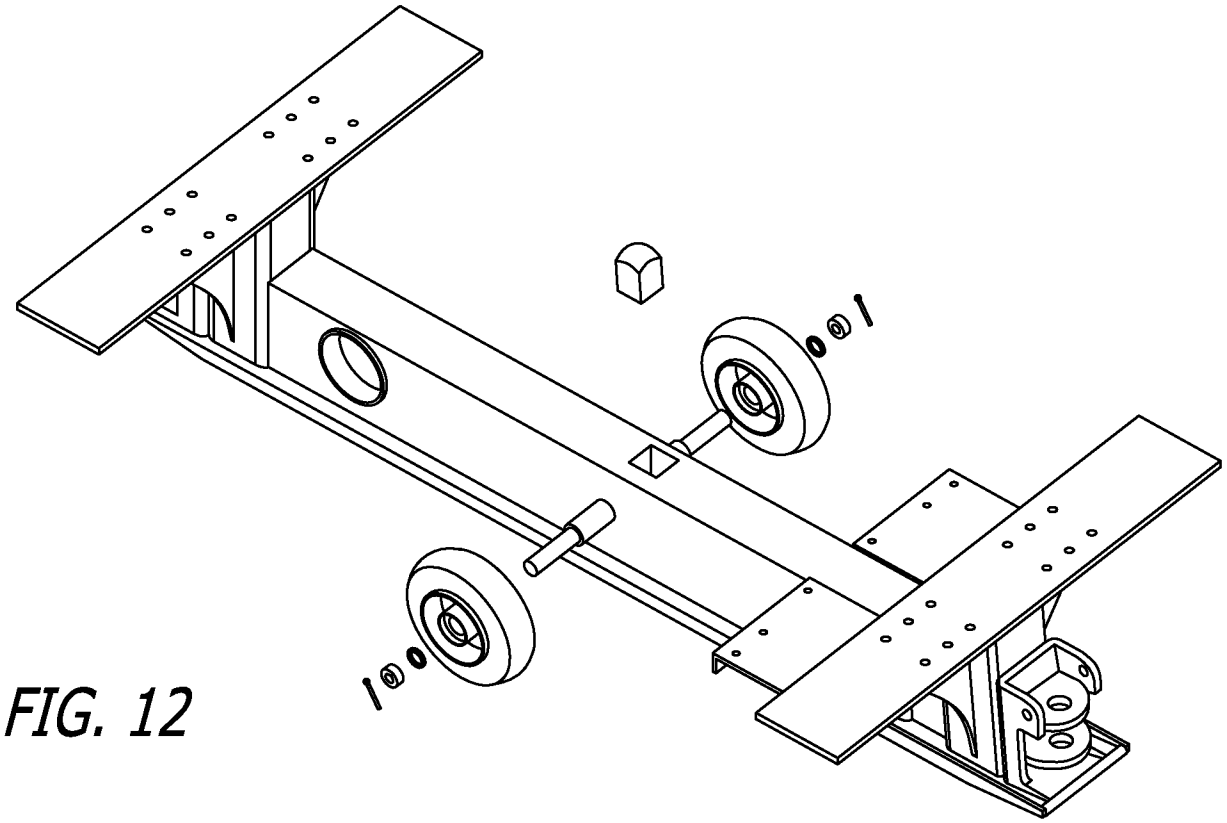
FIG. 12 is an exploded view of the carriage frame and wheel assembly.
Figure 13A:
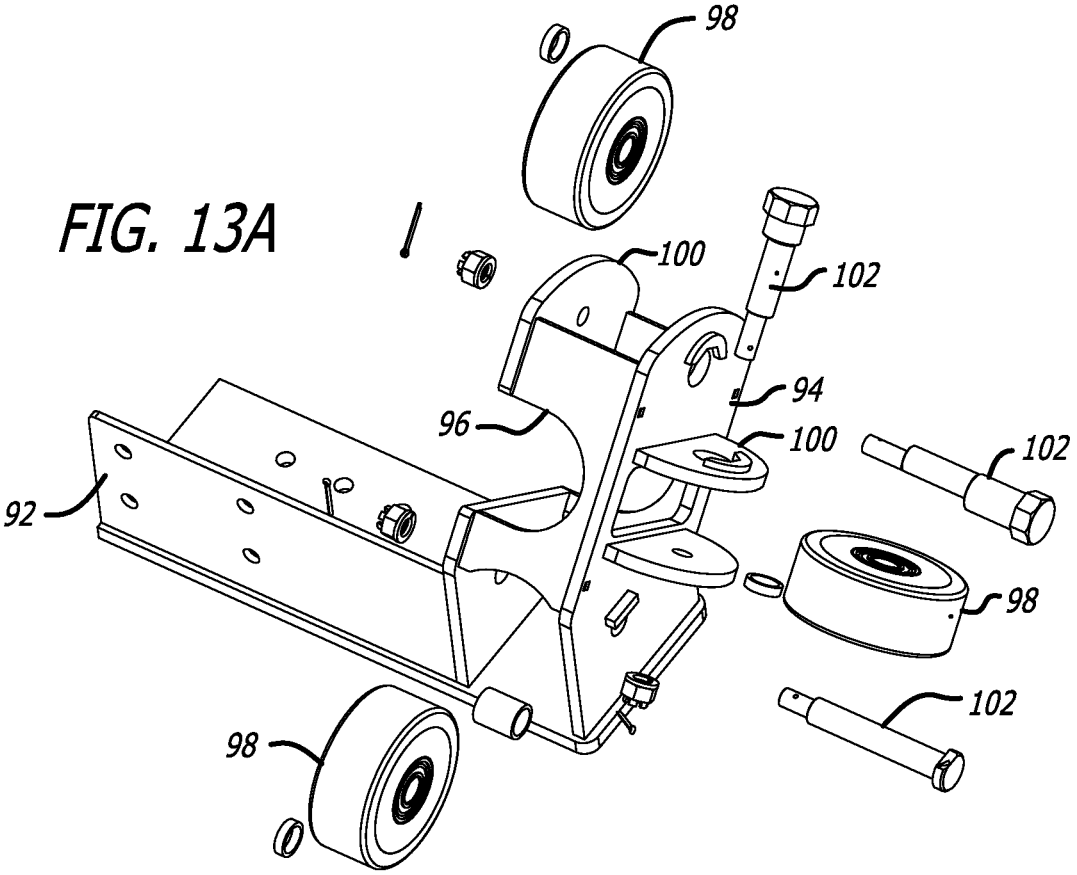
FIG. 13 is an exploded view and assembled view of the side wheel assembly.
Figure 13B:
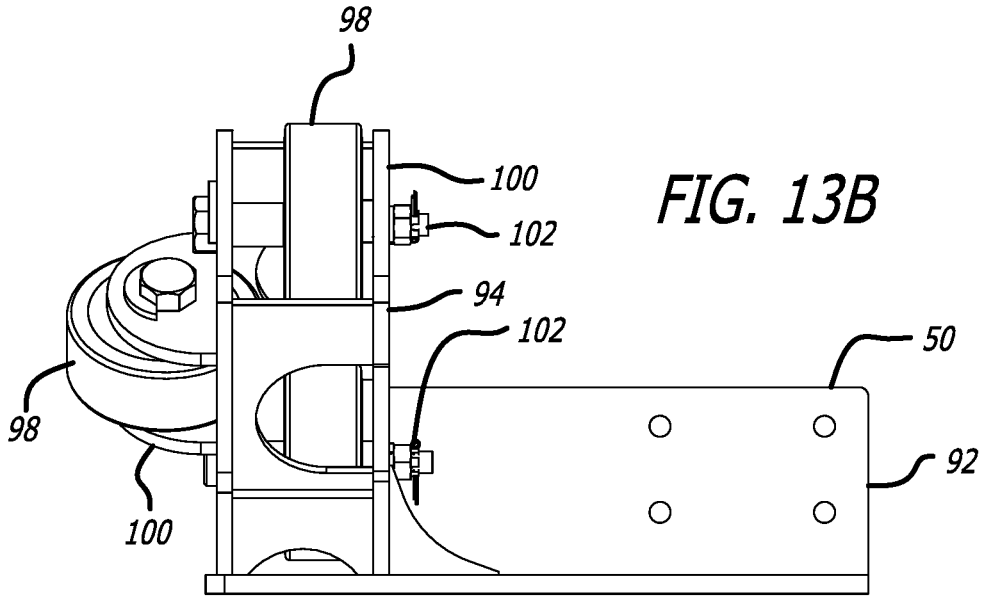

FIGS. 10-12 illustrate the carriage assembly 12 and its main support element 80. Main support element 80 is an I-beam that includes a pin 82 that receives the wheels 46 and two holes 84 that each receive an axle 86 that mount the runner assemblies. At first and second ends of the main support element is a platform 88 onto which two retainer arms 50 are positioned to support the chassis 24. Retainer arm 50 (FIG. 13) comprises a mounting plate 92 and an angled column 94 with a recess 96 that receives one of the inner or outer rings 18, 20. A set of rollers 98 are mounted in the angled column 94 to reduce the friction between the chassis 24 and the retainer arms 50 so that the chassis can move more easily within the recesses 96. The angled column 94 can be formed with lugs 100 that secure the rollers 98 therebetween on a pin 102.

The vehicle 10 is capable of carrying two riders on a roller coaster track and the seats of the vehicle swing about a horizontal axis centered on the cylindrical chassis 24 as the vehicle progresses on its path. The vehicle can be combined with similar vehicles to form a train, or operate independently. To attach two vehicles together, a carriage attachment structure 104 is disposed on each end of the main support element 80 such that when two such carriage attachment structures are mated, a locking pin can be inserted to secure the coupling. The chassis of the seat frame assembly can rotate a full three hundred sixty (360°) degrees within the circular frame to allow the riders to loop within the vehicle. The movement of the seats can be actuated by the riders or the gravitational and/or centripetal forces acting on the vehicle as it moves along the track. In some embodiments, a damping system is imposed to ensure accelerations remain within a predetermined range for the safety of the riders. The vehicle is also controlled by a braking system, which may be pneumatic or hydraulic, for controlling the speed of the car and the position of the seats within the vehicle.

These features and benefits are not limiting, and there are many ways to achieve the objects of the invention in addition to those described and depicted herein, and the scope of the invention is intended to include all such substitutions, modifications, and alterations as would be understood and appreciated by a person of ordinary skill in the art. Nothing in this disclosure should be interpreted as limiting or exclusive unless expressly stated as such. Rather, the breadth of the invention is properly measured by the words of the appended claims hereto, using their plain and ordinary meanings in light of the description and depictions herein.

I claim:

1. A vehicle for movement along a pair of parallel track members, comprising:

An open cylindrical frame formed by first and second parallel circular rings connected at circumferentially spaced intervals by a plurality of cross bars;

first and second opposed seats disposed within the cylindrical frame, each of said first and second seats rigidly mounted to said open cylindrical frame at multiple said cross bars; and a carriage assembly configured for rotatably supporting the open cylindrical frame, the carriage assembly having:

an I-beam parallel to a diameter of the open cylindrical frame;

first and second frame support rollers journaled on a pin extending through the I-beam, each said frame support roller establishing continuous contact with a respective said first and second parallel circular ring at a location directly below the open cylindrical frame;

first and second horizontal platforms extending above said I-beam at respective first and second ends, each said horizontal platform mounting first and second pairs of retainer arms, each retainer arm configured with three frame rollers configured to engage respective portions of the open cylindrical frame;

first and second axles extending through a web portion of the I-beam, each axle having a first end and a second end, each said end including three pairs of rollers where each pair of rollers is configured to contact a separate portion of the parallel track members;

wherein the open cylindrical frame rotates above the carriage assembly as the carriage assembly travels along the parallel track members.

* * * * *